US006226795B1

(12) United States Patent
Winningham

(10) Patent No.: US 6,226,795 B1
(45) Date of Patent: May 8, 2001

(54) CUSTOM-MOLDED HAND PROTECTOR AND METHOD

(75) Inventor: Matthew M. Winningham, Charlotte, NC (US)

(73) Assignee: Parker Athletic Products, LLC, Charlotte, NC (US)

( * ) Notice: Subject to any disclaimer, the term of this patent is extended or adjusted under 35 U.S.C. 154(b) by 0 days.

(21) Appl. No.: 09/560,033

(22) Filed: Apr. 27, 2000

(51) Int. Cl.[7] ..... A61F 5/00; A41D 13/00
(52) U.S. Cl. ..... 2/20; 2/917; 602/6
(58) Field of Search ..... 2/20, 159, 161.1, 2/16, 19, 455, 917; 602/5, 6, 8

(56) References Cited

U.S. PATENT DOCUMENTS

| | | | | |
|---|---|---|---|---|
| 223,049 | * | 12/1879 | Koehler | 602/5 |
| 5,405,312 | | 4/1995 | Jacobs . | |
| 5,423,735 | | 6/1995 | Callinan et al. . | |
| 5,454,780 | | 10/1995 | Duback et al. . | |
| 5,456,658 | | 10/1995 | Duback et al. . | |
| 5,480,376 | | 1/1996 | Duback et al. . | |
| 5,604,931 | | 2/1997 | Rhoades . | |
| 5,640,712 | | 6/1997 | Hansen et al. . | |
| 5,665,056 | | 9/1997 | Nakasugi et al. . | |
| 5,732,713 | * | 3/1998 | Duback et al. | 128/846 |
| 5,755,678 | * | 5/1998 | Parker et al. | 602/6 |
| 5,819,312 | | 10/1998 | Snyder et al. . | |
| 5,898,938 | * | 5/1999 | Baylor et al. | 2/20 |
| 5,974,588 | | 11/1999 | Furman . | |
| 5,980,474 | * | 11/1999 | Darcey | 602/5 |
| 5,983,396 | | 11/1999 | Morrow et al. . | |
| 5,987,642 | | 11/1999 | Webster . | |
| 5,987,646 | | 11/1999 | Bolmer . | |
| 6,042,557 | * | 3/2000 | Ferguson et al. | 602/6 |

* cited by examiner

*Primary Examiner*—John J. Calvert
*Assistant Examiner*—Tejosh Patel
(74) *Attorney, Agent, or Firm*—Adams, Schwartz & Evans, P.A.

(57) ABSTRACT

A custom-fitted hand protector product, including a multi-layer protective pad for being custom-fitted onto the back of the hand to protect the hand of the wearer between the wrist and the fingers. The protective pad comprises a flexible inner cushion layer for being placed closest to the hand and an initially flexible intermediate layer overlying the inner layer, said intermediate layer comprised of a fabric impregnated with a moisture-curable resin which hardens upon curing to form a rigid structure of the fabric which retains a hand-molded shape into which it is molded during curing, thereby also holding the flexible inner cushion layer in the same hand-defined shape. Releasable attachment devices are attached for retaining the protective pad in an exposed, exterior position on the back of the hand. The product is packaged in a moisture-proof package until immediately prior to use.

16 Claims, 6 Drawing Sheets

CUSTOM-MOLDED HAND PROTECTOR AND METHOD

TECHNICAL FIELD AND BACKGROUND OF THE INVENTION

This invention relates to a custom-molded hand protector, and a method of applying custom-fitted protection to the back of the hand. The invention has application in any field—including non-sports related activities—which require or make desirable an accurate custom fit of a protective pad to the hand of the wearer. In the particular embodiment of the invention disclosed herein, the protective pad is shown used in combination with a glove, such as a batting glove worn by baseball players. The invention makes it possible for a glove wearer to protect the back of the hand no matter what kind of glove is being worn. For this reason, the wearer can combine the hand protector according to the invention with customized gloves, gloves worn pursuant to endorsement contracts, and other gloves for which customized hand protection is unavailable.

The invention takes advantage of polymer chemistry to permit quick and easy molding of a pad to the hand. This custom fit spreads impact between an object such as a ball and the back side of the hand over a wider surface area and thus prevents or reduces injury.

The prior art discloses protective gloves which include inserts which are fitted into a glove to provide protection. These devices typically include a soft component to place near the skin and a hard, shell-like outer cover. The soft component is intended not only to provide a cushion, but also to accommodate itself to the varying configurations of differing sized and shaped body parts. For this reason, the cushioned part is substantially greater in thickness than required merely to provide the required amount of shock attenuation. Such devices are sufficiently "generic" in size and shape that they are required to be held in place by straps or bands.

The present invention permits quick and easy fitting of a protective pad to a player in such a way as to still achieve a true custom fit. The moisture curable resin system used results in a very rigid pad which holds the shape of the molded pad to a very high degree. No heat is required, and a source of water is the only additional material necessary to harden the pad. Atmospheric moisture alone will cure the pad into its hardened position in a relatively short period of time, but in practice the resin in or on the pad will typically be activated by dipping in water.

Therefore, it is an object of the invention to provide a protective pad which can be quickly molded to fit the hand of the wearer.

It is another object of the invention to provide a protective pad which can be molded to fit the hand of the wearer without heat.

It is another object of the invention to provide a glove which is used in combination with a protective pad which hardens in the presence of moisture to form a very rigid but very lightweight protective structure.

It is another object of the invention to provide a protective pad to be used in combination with a glove, wherein the pad is held in place by the wrist strap of the glove.

It is another object of the invention to provide a protective pad which is stored in a moisture-proof pouch until ready for application to the hand to be protected.

It is another object of the invention to provide a protective pad which is suitable for protecting against injury, and protecting injuries against further damage.

These and other objects of the present invention are achieved in the preferred embodiments disclosed below by providing a custom-fitted hand protector product, comprising a multi-layer protective pad for being custom-fitted onto the back of the hand to protect the hand of the wearer between the wrist and the fingers. The protective pad comprises a flexible inner cushion layer for being placed closest to the hand and an initially flexible intermediate layer overlying the inner layer, the intermediate layer comprised of a fabric impregnated with a moisture-curable resin which hardens upon curing to form a rigid structure of the fabric which retains a hand-molded shape into which it is molded during curing, thereby also holding the flexible inner cushion layer in the same hand-defined shape. Releasable attachment means are attached for retaining the protective pad in an exposed, exterior position on the back of the hand. The product is packaged in a moisture-proof package until immediately prior to use.

According to one preferred embodiment of the invention, the protective pad includes an outer layer overlying the intermediate layer for being held by the intermediate layer in the same shape as the intermediate layer.

According to another preferred embodiment of the invention, the releasable attachment means comprises a finger loop attached to one side of the protective pad and through which a finger of the hand on which the hand protector is placed is adapted to be inserted.

According to another preferred embodiment of the invention, the releasable attachment means comprises a retention strip attached to a side of the protective pad to be worn adjacent the wrist for holding the protective pad in position on the back of the hand.

According to yet another preferred embodiment of the invention, the releasable attachment means comprises a finger loop attached to one side of the protective pad and through which a finger of the hand is adapted to be inserted; and a retention strip attached to a side of the protective pad opposite the finger loop for holding the protective pad in position on the back of the hand.

According to yet another preferred embodiment of the invention, the retention strip includes touch fastener material thereon for engaging with complementary touch fastener material carried on a wrist strap of a glove over which the hand protector is positioned.

According to yet another preferred embodiment of the invention, the retention strip is adapted for being positioned between complementary touch fastener material carried on opposing, cooperating faces of the wrist strap of the glove.

According to yet another preferred embodiment of the invention, a custom-fitted hand protector is provided, comprising a protective pad for worn on the hand to protect the back of the hand of the wearer between the wrist and the fingers. The protective pad comprises a flexible inner cushion layer for being placed closest to the hand, a rigid structure for providing impact dispersing protection to the back of the hand, and releasable attachment means for cooperating with the hand for retaining the protective pad in an exposed, exterior position on the back of the hand.

According to yet another preferred embodiment of the invention, the releasable attachment means comprises a finger loop attached to one side of the protective pad and through which a finger of the hand on which the hand protector is placed is adapted to be inserted.

According to yet another preferred embodiment of the invention, the releasable attachment means comprises a retention strip attached to a side of the protective pad to be worn adjacent the wrist for holding the protective pad in position on the back of the hand.

According to yet another preferred embodiment of the invention, the releasable attachment means comprises a finger loop attached to one side of the protective pad and through which a finger of the hand is adapted to be inserted, and a retention strip attached to a side of the protective pad opposite the finger loop for holding the protective pad in position on the back of the hand.

According to yet another preferred embodiment of the invention, the retention strip includes touch fastener material thereon for engaging with complementary touch fastener material carried on a wrist strap of a glove over which the hand protector is positioned.

According to yet another preferred embodiment of the invention, the retention strip is adapted for being positioned between complementary touch fastener material carried on opposing, cooperating faces of the wrist strap of the glove.

An embodiment of the method according to the invention comprises the steps of providing a protective pad for being positioned in an overlying position on the back of the hand, providing a loop attached to the protective pad for being placed around a finger on the hand, providing a retention strip attached to the protective pad on a side edge opposite the loop for securing the protective pad in position adjacent the wrist area of the hand, placing the protective pad on the back of the hand, extending a finger on the hand with the loop extended around a finger of the hand, and securing the retention strip to the wrist area to secure the protective pad in position adjacent the wrist.

According to yet another preferred embodiment of the invention, the step of securing the retention strip to the wrist area comprises the step of positioning the retention strip between opposing faces of a wrist strap of a glove positioned on the hand between the hand protector and the hand.

According to another preferred embodiment of the invention, the steps include providing a cushioned inner layer and an initially flexible intermediate layer overlying the inner layer, the intermediate layer comprised of a fabric impregnated with a moisture-curable resin which hardens upon curing to form a rigid structure of the fabric which retains a hand-molded shape into which it is molded during curing, wetting the intermediate layer immediately prior to molding the protective pad to the hand, and molding the protective pad to the back of the hand.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
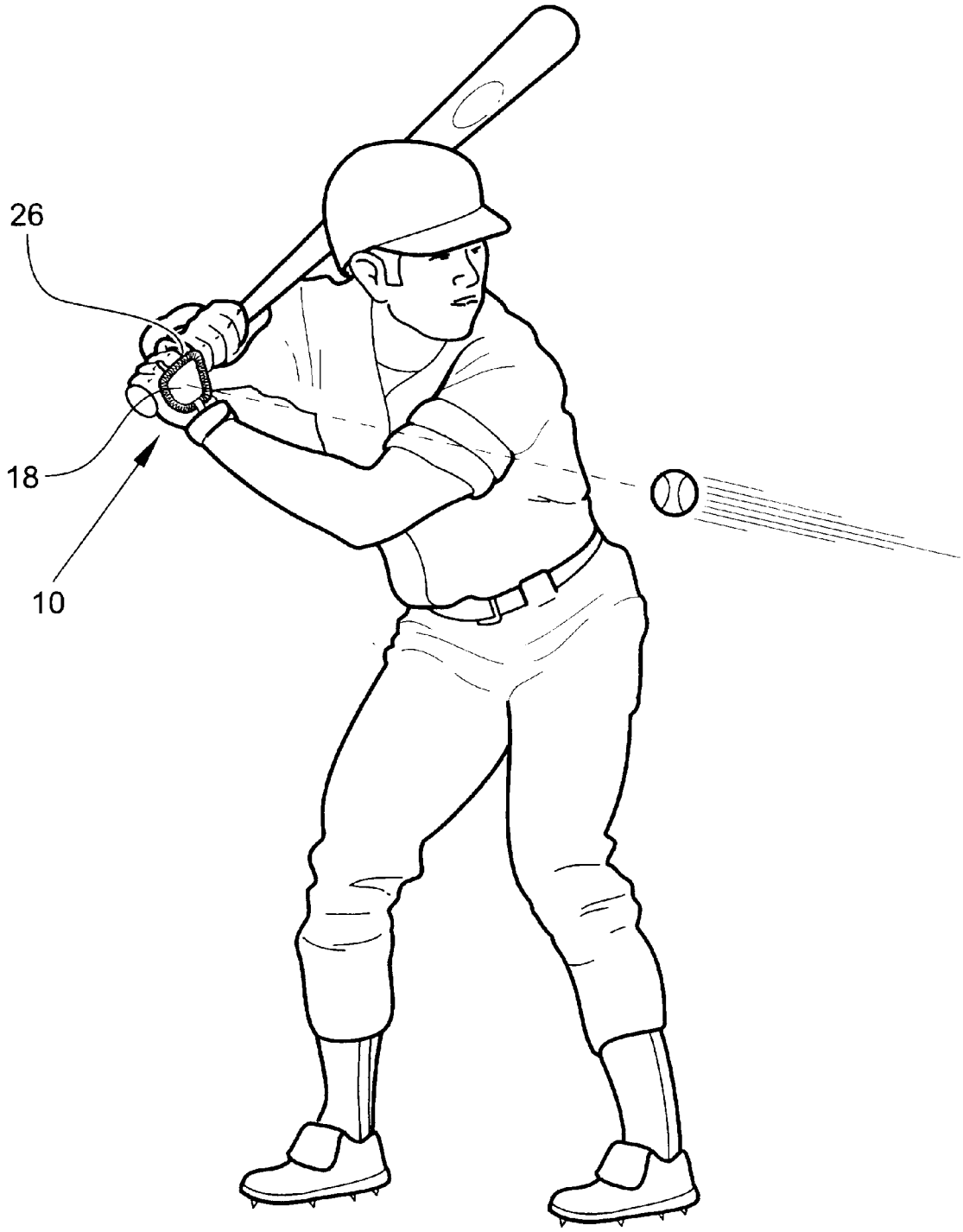
FIG. 1 is a environmental view showing the utility of the hand protector as worn by a baseball player to prevent impact of a ball on the back of the forward-facing hand.
Figure 2:
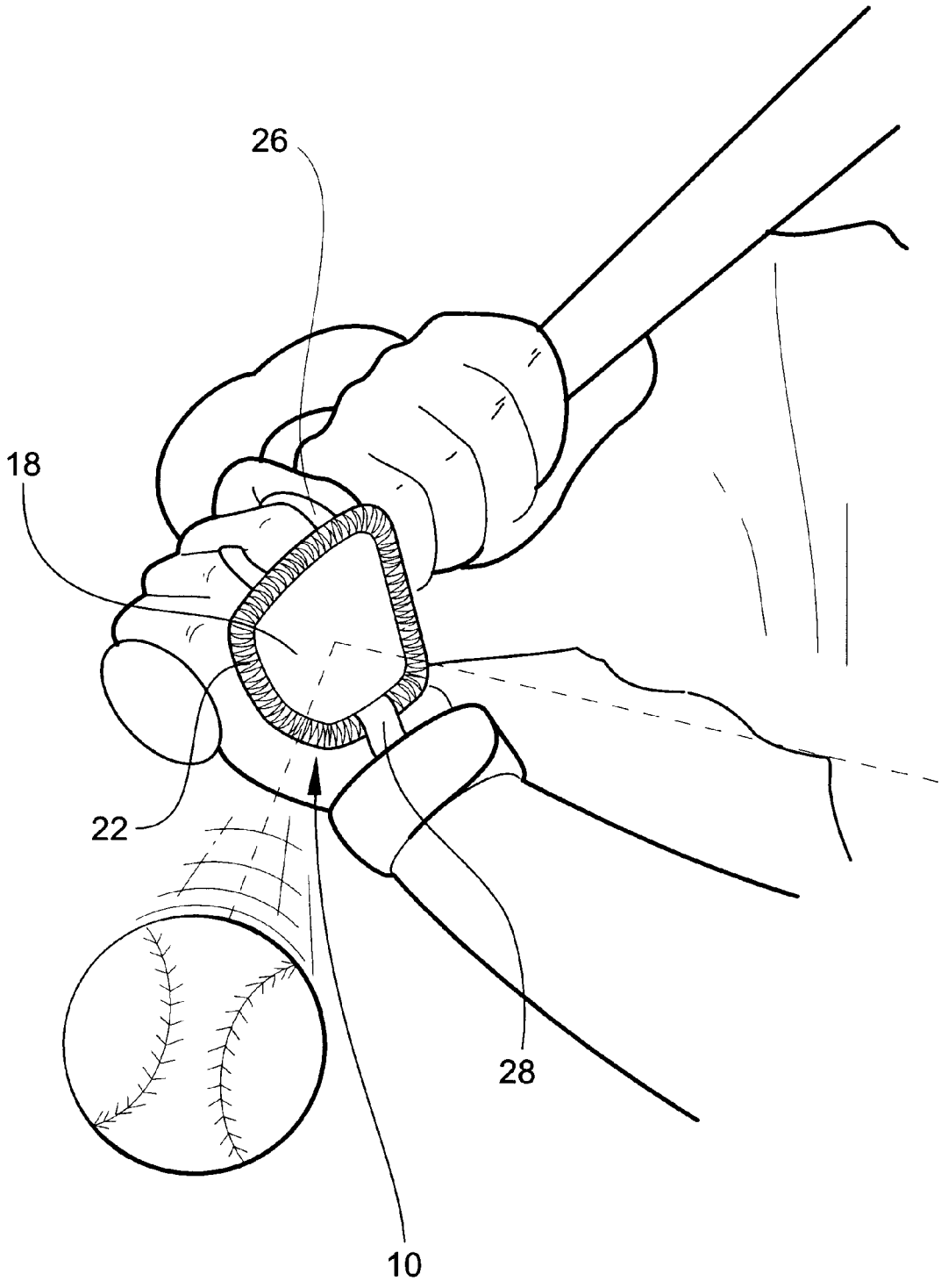
FIG. 2 is close-up view of the hand area of the view shown in FIG. 1.

Referring now specifically to the drawings, FIGS. 1 and 2 illustrate one intended use for the hand protector 10 according to the present invention. While the hand protector 10 is shown in use on a baseball player and positioned over a conventional glove such as worn by most baseball players, the hand protector 10 can also be used by participants in other sports where unintended impact to the back of the hand could cause injury, for example, field hockey, lacrosse, and by construction and industrial workers. The hand protector 10 can be worn without a glove between the hand protector 10 and the hand.

Figure 3:
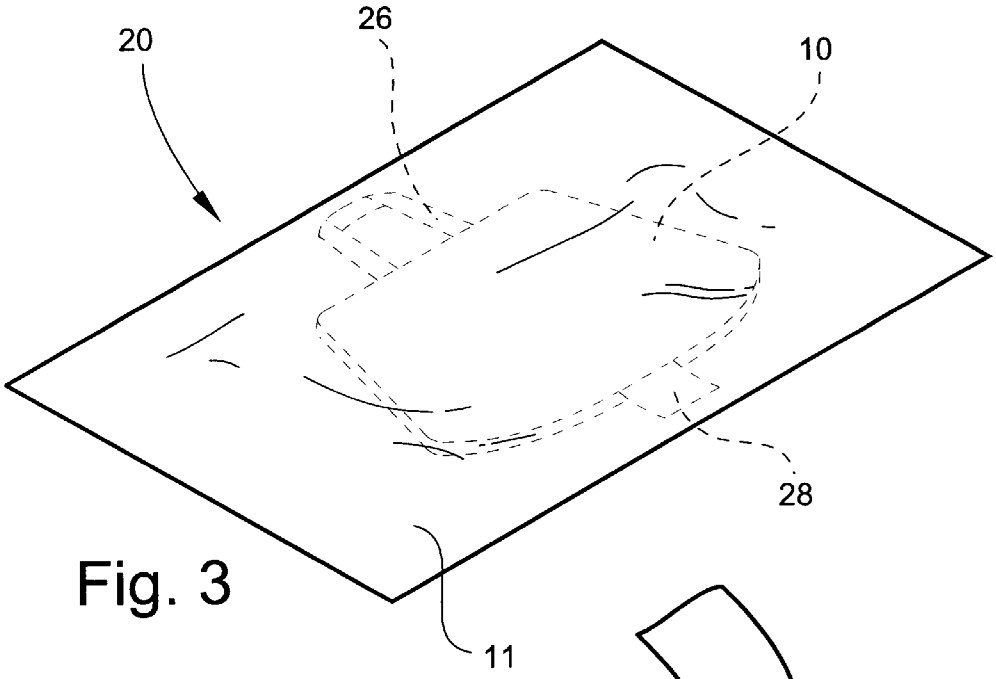
FIG. 3 is a perspective view of a hand protector in its moisture-proof pouch.
Figure 4:
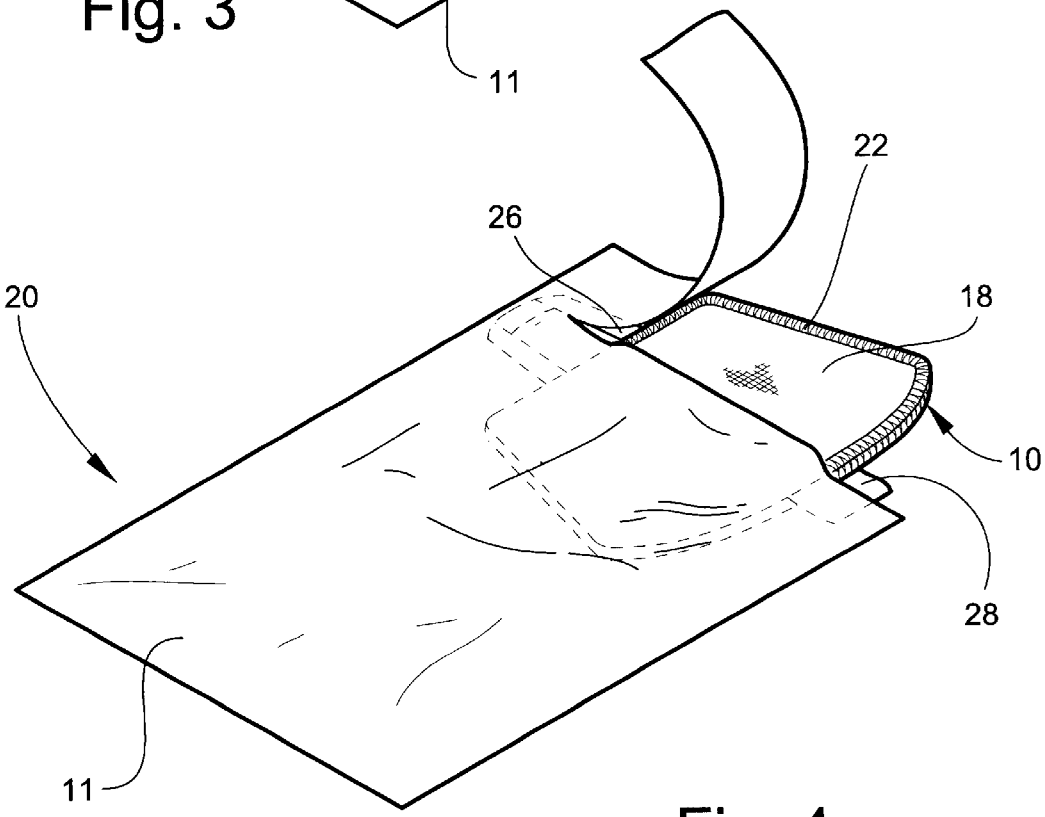
FIG. 4 is a perspective view of the moisture-proof packaging which holds the hand protector, showing removal of the protector from the packaging.
Figure 5:
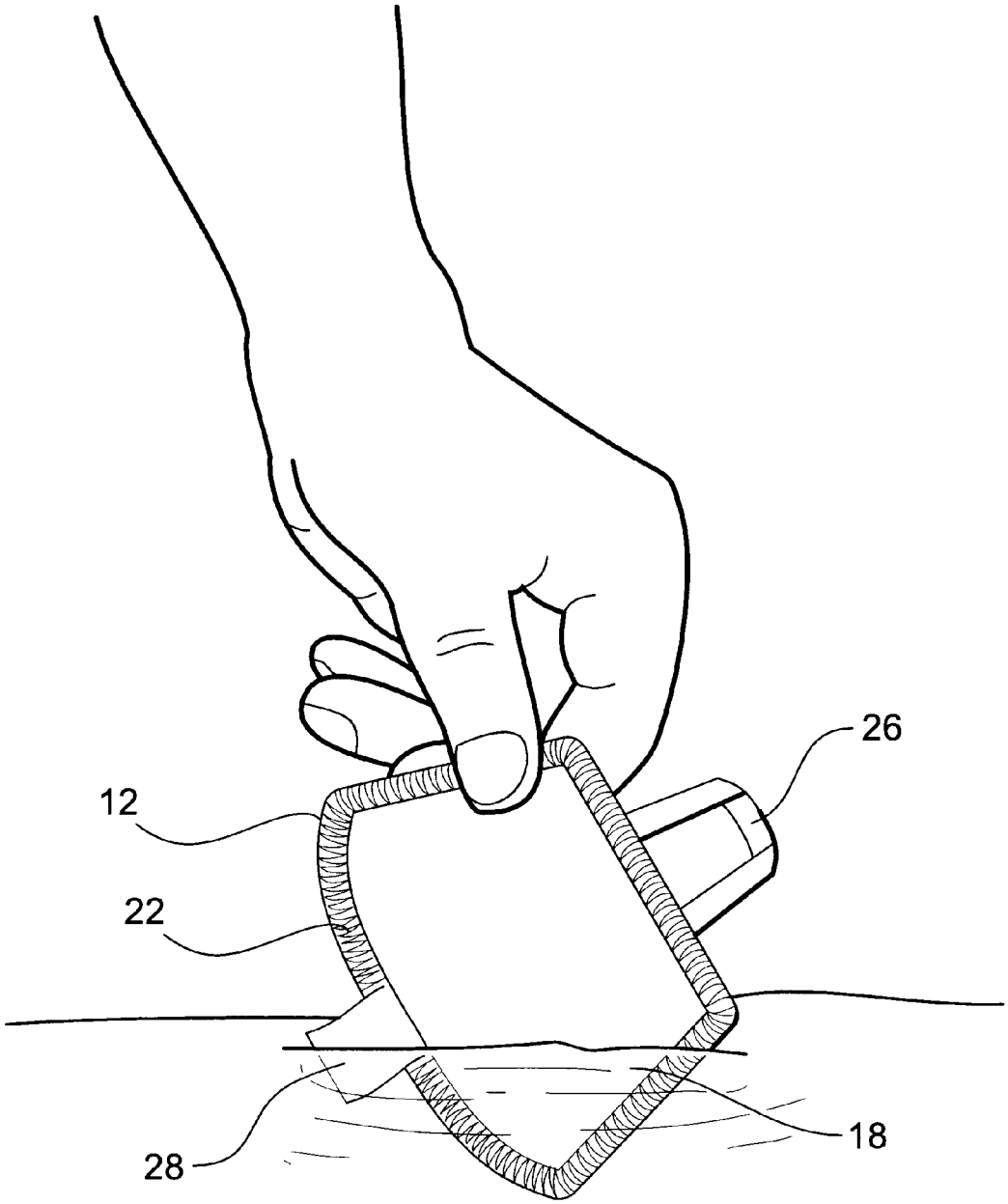
FIG. 5 is a perspective view showing one way of wetting the pad to begin the curing and hardening process.

Referring now to FIGS. 3 and 4, the hand protector 10 is initially contained within a sealed, moisture-impervious foil and plastic laminated pouch 11 in moisture-free condition which is opened with scissors or a knife. The combination of the hand protector 10 and the pouch 11 comprise a hand protector product 20 according to one embodiment of the invention. The hand protector 10 removed from the pouch immediately prior to use. The hand protector 10 is dipped in water to activate the moisture-curable resin with which the hand protector is impregnated or coated, as is shown in FIG. 5. The wet hand protector 10 is then immediately applied to the back of the hand. Preferably, the hand protector is held in place against the hand with an overwrapped elastic bandage, tape or other binding so that as the curing takes place the exact conformation of the hand is transferred to the hand protector 10. The hand protector 10 will harden within a matter of minutes, and will permanently retain the conformation in which it was held during curing. Then, the overwrapping is removed. This process is a nonreversible chemical reaction, not a thermosetting process whereby a thermoplastic material is heated and then molded.

Figure 6:
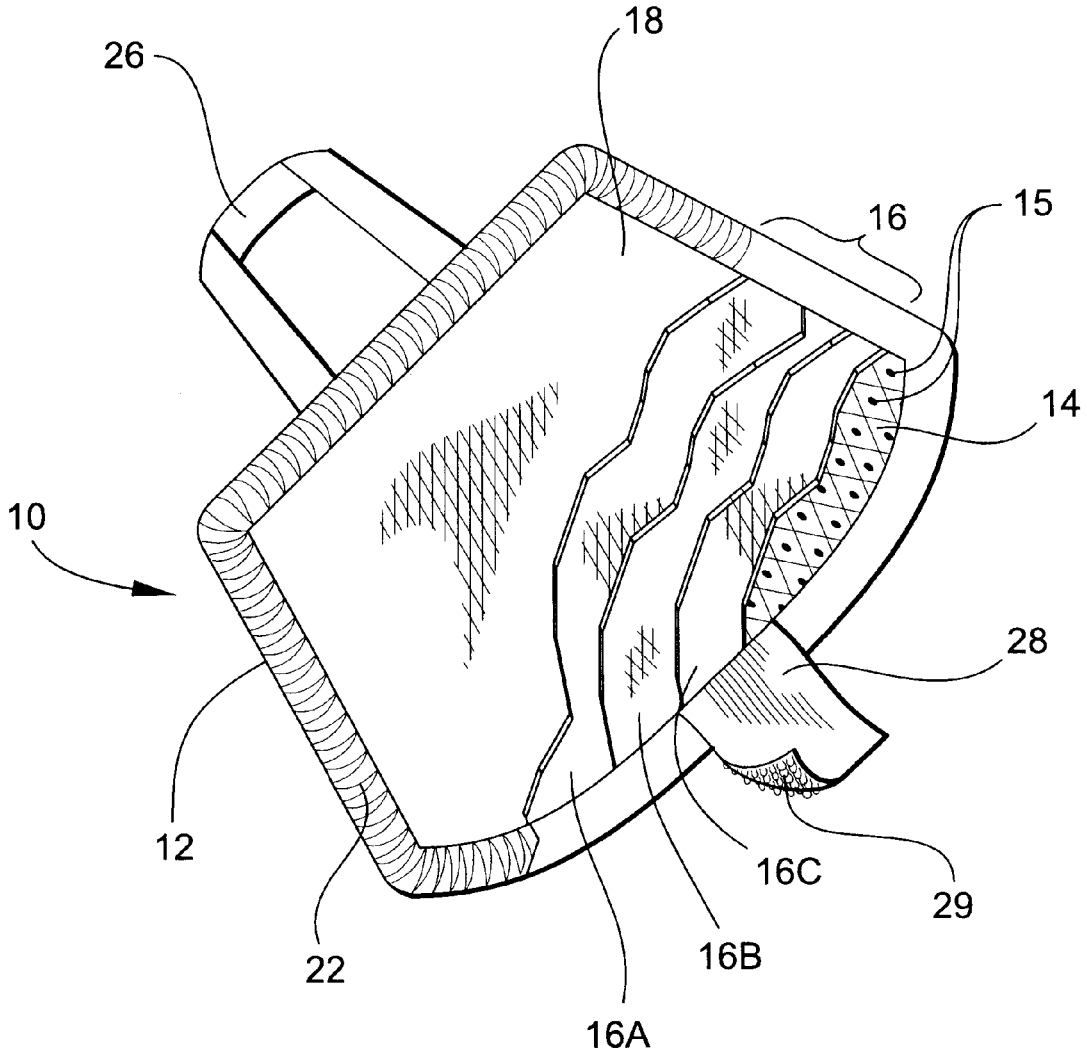
FIG. 6 is a perspective view of the moisture-curable hand protector with parts broken away to illustrate the laminated structure of the protective pad.

Referring now to FIG. 6, the hand protector 10 is illustrated and described more specifically. Hand protector 10 includes a multi-layer protective pad 12 for being custom-fitted to the hand. The pad 12 includes an inner cushion layer 14, preferably a laminated one-eighth inch, six pound EVA (ethylene vinyl acetate) foam cushion. Other thicknesses and weights of cushioning, both laminated and single-thickness, can also be used. Holes 15 in any predetermined arrangement are provided for allowing water to easily and quickly pass into contact with the moisture curable resin material inside the pad 12 and to promote ventilation through the cushion layer 14 after curing and during use. The cushion layer 14 provides a comfortable surface next to the skin glove. The EVA is flexible enough to bend easily with the other components of the pad 12 during fitting and curing.

An initially flexible intermediate layer 16 comprising three overlaid sheets of fiberglass fabric 16A, 16B, 16C is impregnated with a moisture-curable resin which hardens upon curing to form a rigid structure which retains shape of the hand onto which it is molded during curing. The resin is one such as a polyisocyanate as described in full in the U.S. Pat. No. 4,770,299. This reactive system remains stable when maintained in substantially moisture-free conditions, such as in the moisture-impervious pouch 11, but hardens upon exposure to sufficient moisture to form a rigid, self-supporting structure. A typical formulation of the reactive system is set forth in the following table:

| Typical Formulation: | | |
|---|---|---|
| Isonate ↓ 143L or Mondur ↓ CD or Rubinate ↓ XI168 | polyisocyanate | 50.0% |
| Pluracol ↓ P1010 | polyol | 46.6% |
| DC-200 Silicone | defoaming agent | 0.30% |
| Benzoyl Chloride | stabilizer | 0.10% |
| Thancat ↓ DM-70 | catalyst | 3.0% |
| | | 100% |

A complete discussion of the parameters of the reactive system, the manner of production and the variables which apply are found in U.S. Pat. No. 4,411,262.

The polyisocyanate resin remains in a viscous, liquid unhardened state so long as the resin is not exposed to moisture. This permits the fiberglass intermediate layer 16 and the cushion layer 14 to remain flexible and moldable so long as the resin is not exposed to moisture, and for a relatively short period of time after exposure to moisture. The curing time can be controlled to some extent by the quantity of water to which the resin is exposed. For example, exposure to water by dipping will result in quite rapid curing, while merely allowing the resin to be exposed to air will cause long curing times proportional to the amount of moisture in the air to which it is exposed.

In accordance with the invention, a pad having an intermediate layer comprised of a single layer of relatively thicker fiberglass may also be used. Other fabrics, woven or nonwoven, maybe used, including fabrics made of a composition of aluminum oxide, silicone oxide and boron oxide and sold under the trademarkNextel 440 by Thermostatic Industries, Inc.; silica-based fabrics, high modulus fabrics sold under the DuPont trademark "Kevlar." Another suitable fabric is a single thickness sheet of random laid non-continuous polyester nonwoven fabric incorporating a styrene-soluble binder filled 60 percent by volume with plastic microspheres. The product is sold under the trademark "Firet Coremate XM" by Baltek. This product is available in 2 mm, 3 mm and 4 mm thicknesses. The 2 mm thickness is suitable, weighs 2.7–3.2 oz/yd$^2$, has a cured specific gravity of 31.0–37.0 lb/ft$^3$, and a resin consumption of 3.1–3.3 oz/ft$^3$.

Other Firet Coremat grades, such as Firet Coremat XX and Firet Coremat XW may also be suitable. These grades are filled with plastic microspheres to 50 percent by volume. Other products which may be suitable include a low density, nonwoven continuous strand fabric such as BaltekMat T-2000. This product has characteristics which are generally similar to Firet Coremat, but is generally unavailable in small quantities.

An overlaid outer covering layer 18, which may suitably be fabric, plastic or other covering material, may be used to cover the intermediate layer 16. The layers 14, 16 and 18 are sewn to each other by overedge sewing stitches 22 which extend completely around the periphery of pad 12, and which completely encapsulate the fiberglass intermediate layer 16.

The hand protector 10 is retained on the hand by means of a finger loop 26 and a retention strip 28 with touch fastener loops 29 on the inner side. Both the finger loop 26 and the retention strip 18 are secured to the protective pad 12 by being sewn onto the protective pad 10 by the seam 22.

Figure 7:
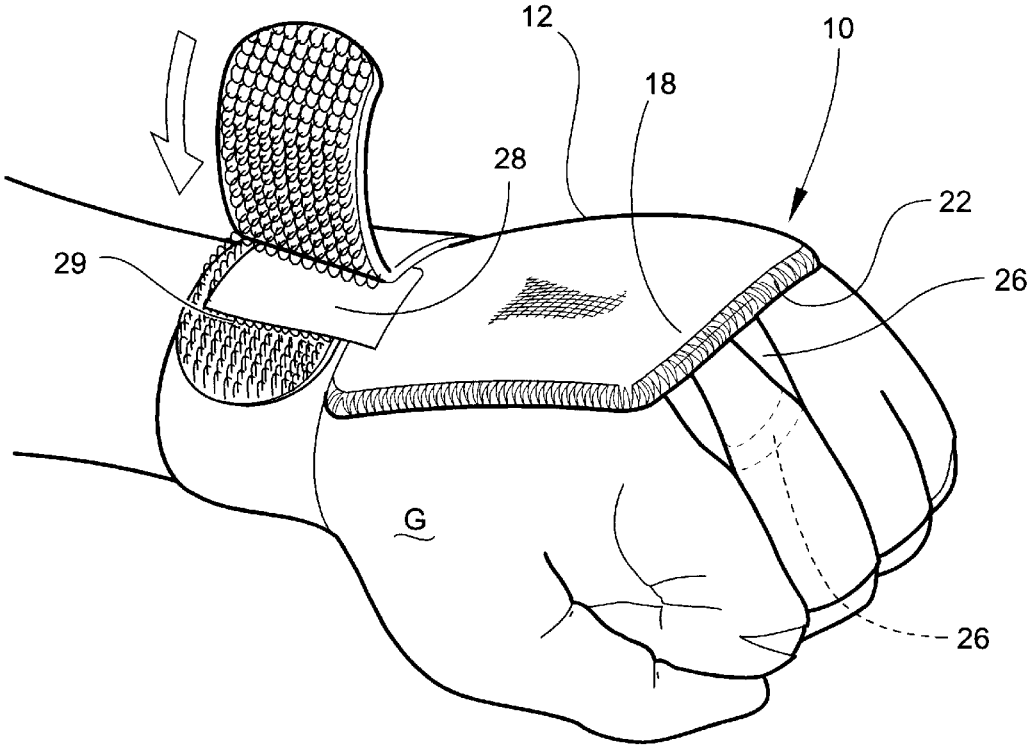
FIG. 7 is an enlarged view of the hand protector in place on the hand.

As is shown in FIG. 7, the hand protector 10 is placed on the back of the hand over a glove "G" with the protective pad 12 positioned between the fingers and the wrist. The finger loop 26 is looped over one of the fingers, for example, the middle finger as shown. This holds the forward side edge of the pad 12 in place next to the back of the hand. The retention strip 28 is then stretched over the wrist area of the glove "G." As is shown, the wrist area of the glove "G" is formed of a cuff having a strip of hook-shaped touch fastener members thereon. The loops 29 of the retention strip 28 mate with the hooks on the cuff to securely lock the pad 12 onto the back of the hand. The wrist strap portion of the cuff is provided with loops which mate with the still-exposed hooks of the cuff to further lock the pad 12 in place on the back of the hand.

As is apparent from the foregoing, the hand protector 10 may be very quickly placed on the hand and very quickly removed. Thus, a batter can quickly and easily secure the hand protector 10 in place as he approaches the plate, and remove it when retired or reaching base. The batter may wear the hand protector 10 with any conventional glove or with no glove at all.

The retention strip may be formed of other attaching devices, such as a strap and buckle, one or more snap fasteners, elastic strap or straps, separate or oppositely-faced touch fasteners, among others. The finger loop 26 is preferably formed of a doubled fabric structure similar to a belt loop, but may be formed of any suitable cord-like material.

A custom-fitted hand protector is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A custom-fitted hand protector product, comprising:

(a) a multi-layer protective pad for being custom-fitted onto the back of the hand to protect the hand of the wearer between the wrist and the fingers, said protective pad comprising:

(i) a flexible inner cushion layer for positioning on the back of the hand; and (ii) an initially flexible intermediate layer overlying the inner layer, said intermediate layer comprised of a fabric impregnated with a moisture-curable resin which hardens upon curing to form a rigid structure of the fabric which retains a shape into which it is molded during curing, thereby also holding the flexible inner cushion layer in the same hand-defined shape; and (iii) wherein the inner cushion and the intermediate layer are configured to engage the back of the hand while not covering any other part of the hand;

(b) releasable attachment means for retaining the protective pad in an exposed, exterior position on the back of the hand the attachment means being a non-encircling tab;

(c) a moisture-proof package within which the hand protector is positioned until immediately prior to use.

2. A hand protector according to claim 1, wherein said protective pad includes an outer layer overlying the intermediate layer for being held by the intermediate layer in the same shape as the intermediate layer.

3. A hand protector according to claim 1, wherein said releasable attachment means comprises a finger loop attached to one side of the protective pad and through which a finger of the hand on which the hand protector is placed is adapted to be inserted.

4. A hand protector according to claim 1, wherein said releasable attachment means comprises a retention strip attached to a side of the protective pad to be worn adjacent the wrist for holding the protective pad in position on the back of the hand.

5. A hand protector according to claim 2, wherein said releasable attachment means comprises:

(a) a finger loop attached to one side of the protective pad and through which a finger of the hand is adapted to be inserted; and (b) a retention strip attached to a side of the protective pad opposite the finger loop for holding the protective pad in position on the back of the hand.

6. A hand protector according to claim 2 or 3, wherein said retention strip includes touch fastener material thereon for engaging with complementary touch fastener material carried on a wrist strap of a glove over which the hand protector is positioned.

7. A hand protector according to claim 6, wherein said retention strip is adapted for being positioned between complementary touch fastener material carried on opposing, cooperating faces of the wrist strap of the glove.

8. A custom-fitted hand protector, comprising:

(a) a protective pad for being worn on the hand to protect the back of the hand of the wearer between the wrist and the fingers, said protective pad comprising:

(i) a flexible inner cushion layer for positioning on the back of the hand;

(ii) a rigid structure for overlying the cushion layer and for providing impact dispersing protection to the back of the hand; and (b) releasable attachment means for cooperating with the hand for retaining the protective pad in an exposed, exterior position on the back of the hand the attachment means being a non-encircling tab.

9. A hand protector according to claim 8, wherein said releasable attachment means comprises a finger loop attached to one side of the protective pad and through which a finger of the hand on which the hand protector is placed is adapted to be inserted.

10. A hand protector according to claim 8, wherein said releasable attachment means comprises a retention strip attached to a side of the protective pad to be worn adjacent the wrist for holding the protective pad in position on the back of the hand.

11. A hand protector according to claim 9, wherein said releasable attachment means comprises:

(a) a finger loop attached to one side of the protective pad and through which a finger of the hand is adapted to be inserted; and (b) a retention strip attached to a side of the protective pad opposite the finger loop for holding the protective pad in position on the back of the hand.

12. A hand protector according to claim 9 or 10, wherein said retention strip includes touch fastener material thereon for engaging with complementary touch fastener material carried on a wrist strap of a glove over which the hand protector is positioned.

13. A hand protector according to claim 10, wherein said retention strip is adapted for being positioned between complementary touch fastener material carried on opposing, cooperating faces of the wrist strap of the glove.

14. A method of protecting the back of a hand between the fingers and wrist, and comprising the steps of:

(a) providing a protective pad for being positioned in an overlying position on the back of the hand;

(b) providing a loop attached to the protective pad for being placed around a finger on the hand;

(c) providing a non-circling retention strip attached to the protective pad on a side edge opposite the loop for securing the protective pad in position adjacent the wrist area of the hand;

(d) placing the protective pad on the back of the hand;

(e) extending a finger on the hand with the loop extended around a finger of the hand; and (f) securing the retention strip to the wrist area to secure the protective pad in position adjacent the wrist.

15. A method according to claim 14, wherein the step of securing the retention strip to the wrist area comprises the step of positioning the retention strip between opposing faces of a wrist strap of a glove positioned on the hand between the hand protector and the hand.

16. A method according to claim 14, and including the steps of:

(a) providing a cushioned inner layer and an initially flexible intermediate layer overlying the inner layer, said intermediate layer comprised of a fabric impregnated with a moisture-curable resin which hardens upon curing to form a rigid structure of the fabric which retains a hand-molded shape into which it is molded during curing;

(b) wetting the intermediate layer immediately prior to molding the protective pad to the hand; and (c) molding the protective pad to the back of the hand.

* * * * *